US007267499B2

(12) United States Patent
Nakanishi

(10) Patent No.: US 7,267,499 B2
(45) Date of Patent: Sep. 11, 2007

(54) SYSTEM, APPARATUS AND METHOD FOR PRINTING OVERSIZED PRINT MEDIA

(76) Inventor: Tadayoshi Nakanishi, 1152-3 Fueta, Kamakura City, Kanagawa-Ken (JP) 248-0027

( * ) Notice: Subject to any disclaimer, the term of this patent is extended or adjusted under 35 U.S.C. 154(b) by 0 days.

(21) Appl. No.: 11/297,836

(22) Filed: Dec. 7, 2005

(65) Prior Publication Data

US 2006/0088358 A1 Apr. 27, 2006

Related U.S. Application Data

(63) Continuation of application No. 09/626,040, filed on Jul. 27, 2000, now Pat. No. 7,008,128.

(51) Int. Cl.
*B41J 15/00* (2006.01)

(52) U.S. Cl. ..... 400/578; 400/582; 400/611

(58) Field of Classification Search ..... 400/578, 400/582, 611; 101/35, 37, 41–44
See application file for complete search history.

(56) References Cited

U.S. PATENT DOCUMENTS

| | | | | |
|---|---|---|---|---|
| 3,092,686 A | | 6/1963 | Johnson | |
| 4,232,462 A | | 11/1980 | Longenecker | 40/119 |
| 4,283,871 A | | 8/1981 | Applebaum et al. | 40/768 |
| 4,547,786 A | | 10/1985 | Logan et al. | |
| 4,575,730 A | | 3/1986 | Logan et al. | |
| 4,580,914 A | | 4/1986 | Rich et al. | |
| 4,740,125 A | | 4/1988 | Dillow | 412/1 |
| 4,823,150 A | | 4/1989 | Kage et al. | 346/146 |
| 4,914,522 A | | 4/1990 | Duffield et al. | |
| 4,937,678 A | | 6/1990 | Murai et al. | |
| 4,999,651 A | | 3/1991 | Duffield et al. | |
| 5,456,172 A | * | 10/1995 | Herrmann | 101/115 |
| 5,647,583 A | | 7/1997 | Emigh et al. | 270/52.04 |
| 5,661,509 A | | 8/1997 | Dochovna | |
| 5,801,721 A | | 9/1998 | Gandy et al. | |

(Continued)

OTHER PUBLICATIONS

VUTEK Digital Printing System, Sep. 1998 (Product Overview).

(Continued)

*Primary Examiner*—Minh Chau
(74) *Attorney, Agent, or Firm*—Koppel, Patrick, Heybl & Dawson; Michael J. Ram

(57) ABSTRACT

Embodiments of the invention are directed to a system, apparatus, and method for printing oversized print media which allow for the printing of a preassembled substrate or a single piece substrate without compromising the integrity of the print quality. Preferred embodiments of the invention comprise a series of stations, wherein a specific task is performed at each station. Prior to printing an image, in preferred embodiments, print substrate segments are preassembled into image size substrates such that upon the completion of printing, the product is complete. A preassembled print substrate is loaded onto the platform at the loading station. Once the print substrate is loaded onto the platform, the platform is linearly translated to the printing station, whereby the platform is incrementally moved under a print head. During printing, the portion of the print substrate being printed is elevated such that the substrate is taut. Upon the completion of the printing task, the printed substrate is unloaded, rolled and prepared for packaging.

7 Claims, 14 Drawing Sheets

U.S. PATENT DOCUMENTS 5,887,519 A * 3/1999 Zelko ..... 101/115
5,984,624 A 11/1999 Opfer et al. ..... 414/798.5
6,059,391 A * 5/2000 Fulkerson et al. ..... 347/2
6,071,030 A 6/2000 Hunter et al. ..... 402/79
6,134,016 A 10/2000 Watanabe et al. ..... 358/98
6,175,700 B1 1/2001 Miller et al.
6,246,461 B1 6/2001 Hinsberg ..... 352/98
6,276,266 B1 8/2001 Dietz et al.
6,299,786 B1 10/2001 Silverbrook
6,693,718 B1 2/2004 Takaoka ..... 358/1.15

OTHER PUBLICATIONS

SignJet Pro, Western Graphtech 1998 (Product brochure/advertisement).
Scitex GrandJet V (Product advertisement).
Nur Blueboard HiQ (Product advertisement).
Gamme Jaime 1000 User Manual.

* cited by examiner

SYSTEM, APPARATUS AND METHOD FOR PRINTING OVERSIZED PRINT MEDIA

RELATED APPLICATIONS

This application is a continuation of application Ser. No. 09/626,040, entitled "A System, Apparatus and Method for Printing Oversized Print Media", filed Jul. 27, 2000 now U.S. Pat. No. 7,008,128, and claims the benefit of this filing date.

FIELD OF THE INVENTION

This invention is directed to a system, apparatus and method for printing oversized print media. More specifically, this invention is directed to a system that utilizes an assembly-line linear transport system to print oversized material for billboards, or large scale graphics, wherein a single, preassembled print substrate progresses from a loading station, to a printing station, to an unloading and delivery station.

BACKGROUND OF THE INVENTION

The field of graphic art and the printing of various media for advertisements, presentations and the like, is well established and, in most instances, systematized. Overall, for most printing tasks, artwork is received by a printer in an appropriate format. The image or picture to be printed is color adjusted and edited as appropriate for the presentation of the material. The edited and color corrected image is scanned and saved onto a storage media, such as a CD Rom, or other storage media, including, hard disks and floppy disks. The files on the storage media are read by a computer which is coupled to a printing device. At the time of printing, the files are read by the computer, which instructs the printing device as to printing the image onto a print media.

Although the field of graphic art and print media are fairly well established and efficient for most printing tasks, problems arise as the desired size of the finished product increases in size. Indeed, the production of graphics for oversized print media, such as, billboards, poses problems associated with the design of appropriate printing equipment, storage of materials, and delivery time of the final product to the client.

Currently, at least two types of printing systems exist to produce graphics for oversized media; namely, a flat bed system and a drum system. In the flat bed system, the printing device comprises a flat bed and a print head, wherein the print head resides above the flat bed. A piece of material or substrate is secured onto the flat bed, wherein the material is sized to correspond to the size of the flat bed. The print head, which is a piezoelectric gun, is coupled to an arm that moves the print head across the width of the flat bed.

The printing device further comprises a processor, such as a computer, wherein the processor is in electronic communication with the print head. The computer reads the image from the storage device and instructs the print head in the printing of the media.

Although the flat bed system allows for the printing of larger media, the flat bed is limited in size. Indeed, in the instance of a billboard sign, the flat bed does not represent the true size of the final product. Rather, the image is printed in segments 2, wherein each segment of the image is printed onto a different piece of print material. The pieces of material are later seamed together to form the entire image, or printed substrate 4, such as, the billboard sign (FIG. 1).

To attach the printed billboard image to the billboard, the printed substrate requires coupling elements. In current systems, the coupling elements 6 are borders on the printed substrates. With reference to FIG. 1, borders 6 are formed by folding and attaching a separate segment of the print material along a portion of each of the sides of the substrate, wherein the ends of the borders are open such that a loop 8 is formed by the folded material. The loops 8 are designed to receive and support a rope, or other attachment means, which is threaded through the interior of the loop 8 such that a piece of the rope extends beyond each end of the loop. The exposed rope can be used to secure the printed substrate 4 to the billboard, wherein the rope in the loop holds the side of the printed substrate against the billboard. The addition of the borders increases the size of the printed substrate, increases the height, or thickness, of a portion of the print substrate, and increases the time before the printed billboard can be delivered.

In the drum system, a large drum is used to print the image. In current drum systems, the drum is approximately 20 feet wide and has a 60 foot circumference. Due to the large size of the drum head, the printing materials, which are stored on rolls, are very large and cumbersome. Further, currently used drum systems utilize proprietary equipment, which is not typically available for manufacturers. The unavailability of preexisting proprietary equipment is compounded by the expense of manufacturing, purchasing and developing equipment to use in the drum systems. As the drums are expensive to manufacture, purchase and develop, it is unlikely that the drums will be redesigned to accommodate newly entering businesses; thereby further minimizing availability of these systems.

Although the above described systems are used and allow the printing of oversized print media, these systems present certain problems. As stated above, the drum system is not typically used due to the size of material required for the drum and the expense of the drum equipment. Further, the unavailability of the preexisting systems to most manufacturers prohibit entry into the field unless the entrant desires to manufacture and develop another system.

Further, in all flat bed systems, delivery time for a printed billboard image is typically from two to five weeks. This is due, in part, to the fact that the images are printed in segments, wherein the segments are assembled into the billboard image subsequent to printing. Assembly of the printed segments is typically 2-½ hours. Thus, delivery of the printed billboard is affected by the assembly time which cannot currently be reduced. In most current systems, a maximum of 8-10 images can be printed per day. However, these 8-10 printed images require approximately 16-25 additional hours of labor for post printing assembly prior to the delivery of the billboard image to the customer.

In addition, the current systems are restrained by the required printing distance between the material and the print heads. For instance, with respect to the flat beds, as stated above, the print head used in the flat bed system is a piezoelectric gun, which prints most effectively at a predefined optimal distance from the print substrate. Indeed, due to instabilities in these systems, such as motion in the equipment during printing, or the existence of air turbulence created between the substrate and the print head, the print quality of the final product suffers. Thus, to effectively use the flat beds, the print substrate, or material, must be within a preset distance from the guns. Although it is possible to place the guns at a distance which is further than the preset optimal distance from the material, the quality of the printed image is compromised.

In addition, the substrate materials for the flat bed systems are typically delivered too large in size. Thus, the raw materials must be precut and re-rolled prior to use in the systems. This, of course, increases labor and time expense, and further potentially degrades the integrity of the material. Indeed, due to the necessity to cut and re-roll the raw materials, the materials are often wrinkled. At least one inherent problem with the flat bed systems is that the equipment does not ensure that the print substrates are taut and wrinkle free during the printing process. Thus, the printed billboard image often includes voids or distortions in the printed image due to the wrinkles or looseness of the substrate during printing.

As stated above, the addition of the borders increase the thickness or height of the print substrate. As such, the borders cannot be attached prior to printing for either system because the increased thickness would require an increase in the distance from which the guns would need to be fired. Further, as the borders increase the size of the print material, print material with a border would not fit on the currently available flat beds, unless the size of each segment having a border were reduced. This, of course, would increase the number of segments required for an image and thus, increase the amount of printing time required to print the image.

A need in the industry exists for a system that decreases the post production time for the printing of oversized images. A further need exists for a system that more effectively utilizes pre-production time such that the delivery time for the printing of oversized media is reduced. A still further need exists for a system that allows for an effective 'real-time' introduction of new products and services via advertising by oversized images.

SUMMARY OF THE DISCLOSURE

Embodiments of the instant invention are directed to a system, apparatus, and method for printing oversized print media which allow for the printing of a preassembled substrate or a single piece substrate without compromising the integrity of the print quality. Preferred embodiments of the invention comprise a series of stations, wherein a specific task is performed at each station. More specifically, preferred embodiments of the printing system comprise a loading station, a printing station, an unloading and delivery station, a platform and a transportation system.

Prior to the actual printing of an image, in preferred embodiments, print substrate segments are preassembled into image size substrates such that upon the completion of printing, the product is complete. The preassembly of the print substrate segments is preferably performed prior to the need for the preassembled substrate such that no delay is experienced in the fulfillment of the print request. The preassembled print substrates are stored in a predefined area. In some embodiments, the preassembled substrates are stored near the loading station of the printing system for ease of loading.

A preassembled print substrate is loaded onto the platform at the loading station. Once the print substrate is loaded onto the platform, the platform is linearly translated to the printing station, whereby the platform is incrementally moved under a print head.

Upon the completion of the printing task, the platform is moved along a track of the transportation system to the unloading and delivery station where the printed substrate is rolled and prepared for packaging. The finished product is then shipped to the appropriate customer. In preferred embodiments, up to 75 images can be delivered per day.

A feature of preferred embodiments of the present invention is the assembly of segments of the print media into a single print substrate prior to the printing process. An advantage to this feature is that the delivery time for the final product can be reduced as the segments are not seamed or coupled together subsequent to the printing of the segments.

A further feature of preferred embodiments is that the entire image is printed in a single pass of the print media through the printing apparatus. An advantage to this feature is that the amount of time required for printing is reduced because the computer is not required to search and delineate the portion of the image that is currently being printed.

A still further feature of preferred embodiments is that the print head is capable of printing 6-15 inches above the print media without compromising the integrity of the printed image. An advantage to this feature is that borders can be added to the print media prior to printing without affecting the quality of the printing irregardless of the fact that the borders increase the required distance between the print head and the print media during printing.

A further feature of preferred embodiments is that the printing apparatus utilizes a single piece of printing material, instead of a continuous roll of material. An advantage to this feature is that the printing apparatus does not need to store a large roll of material for use in the printer; rather, the required material can be stored at any convenient location. A further advantage is that the single pieces of material can be stored by laying one on top of another, thereby reducing storage requirements for the printing materials.

A further feature of preferred embodiments is that the configuration of the transport mechanism allows the traversal of the platform bed to commence and end at the loading station for each printing assignment. An advantage to this feature is that efficiency in printing is maintained as the platform bed does not need to retrace its print path to be repositioned at the beginning of the process.

A still further feature of preferred embodiments is that multiple platforms can be added to a single track. An advantage to this feature is that the productivity and efficiency of the system is increased. A further advantage is that the cost of the system is reduced as the increase in the number of platforms increases the capability of the system to print without the additional expense of a print station.

A further feature of preferred embodiments is that the transport mechanism can be shared by multiple printing systems. An advantage to this feature is that multiple printing stations can be placed in parallel thereby increasing efficient use of space and increasing productivity.

A still further feature of embodiments of this invention is that the efficiency in printing time is increased such that it allows for the 'real-time' distribution of new information. An advantage to this feature is that a new advertising avenue is created. A further advantage is that new information can be virtually instantaneously received, printed and delivered to clients.

A further feature of embodiments of the instant invention is that the system can be utilized on a network, such as, the Internet or World Wide Web. An advantage to this feature is that information can be received from any location world wide. A further advantage to this feature is that the information can be virtually instantaneously printed and delivered to clients in any location, thereby increasing the productivity and efficiency of the system. Another advantage to this feature is that global markets are made available for clients, as well as, printers.

The above and other advantages of embodiments of this invention will be apparent from the following more detailed description when taken in conjunction with the accompanying drawings. It is intended that the above advantages can be achieved separately by different aspects of the invention and that additional advantages of this invention will involve various combinations of the above independent advantages such that synergistic benefits may be obtained from combined techniques.

BRIEF DESCRIPTION OF THE DRAWINGS

The detailed description of embodiments of the invention will be made with reference to the accompanying drawings, wherein like numerals designate corresponding parts in the figures.

DETAILED DESCRIPTION OF PREFERRED EMBODIMENTS

Embodiments of the instant invention are directed to a system, apparatus and method for printing oversized print media utilizing an assembly-line linear transport system. Embodiments of the system allow the printing of oversized print media without the requirement of post assembly of segments of the printed image.

Figure 2:
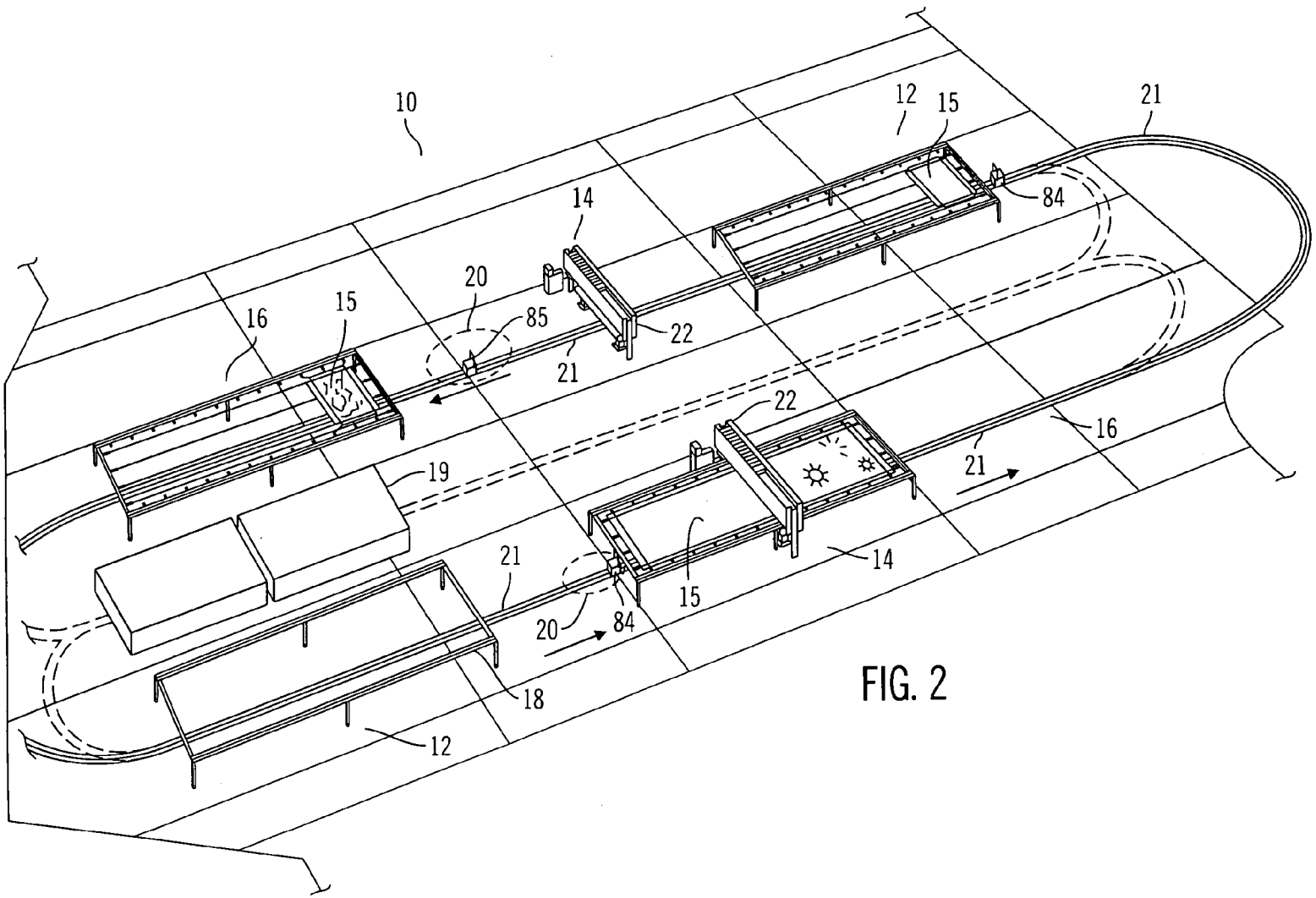
FIG. 2 depicts a printing system in accordance with preferred embodiment of the present invention.

Embodiments of the printing system comprise a series of stations, wherein a specific task is performed at each station. Overall, with reference to FIG. 2, preferred embodiments of the printing system 10 comprise a loading station 12, a printing station 14, an unloading and delivery station 16, a platform 18 and a transportation system 20.

The loading station 12 is the initial station in the printing system 10. The loading station 12 is the area in which the unprinted substrate or print media 15 is loaded and secured onto the platform 18. In preferred embodiments, the loading station 12 is proximal to the storage area for the print substrate or to a supply of the print substrate. The proximity of the print substrate facilitates the loading of the unprinted substrate onto the platform 18 and the commencement of the printing task.

Once the print substrate is loaded onto the platform 18, the platform 18 is linearly translated to the printing station 14, whereby the platform is incrementally moved under a print head. The print head scans the print substrate in a motion that is perpendicular to the translation motion of the platform 18.

Once the printing is completed, the platform 18 is moved along a track 21 of the transportation system 20 to the unloading and delivery station 16 where the printed substrate is rolled and prepared for packaging. Upon completion of the packaging, the printed substrate is shipped to the appropriate customer. In preferred embodiments, up to 75 images can be delivered per day as post production time is virtually eliminated due to the preassembly of the print substrate prior to printing. As such, delivery time of a print order can be within 3-5 days of the request by the customer.

As stated above, the printing station 14 is the station wherein the printing of the substrate is accomplished. In preferred embodiments, the printing station 14 comprises a stationary print platform 22, a moveable print head 24, and a processor 26.

Figure 3:
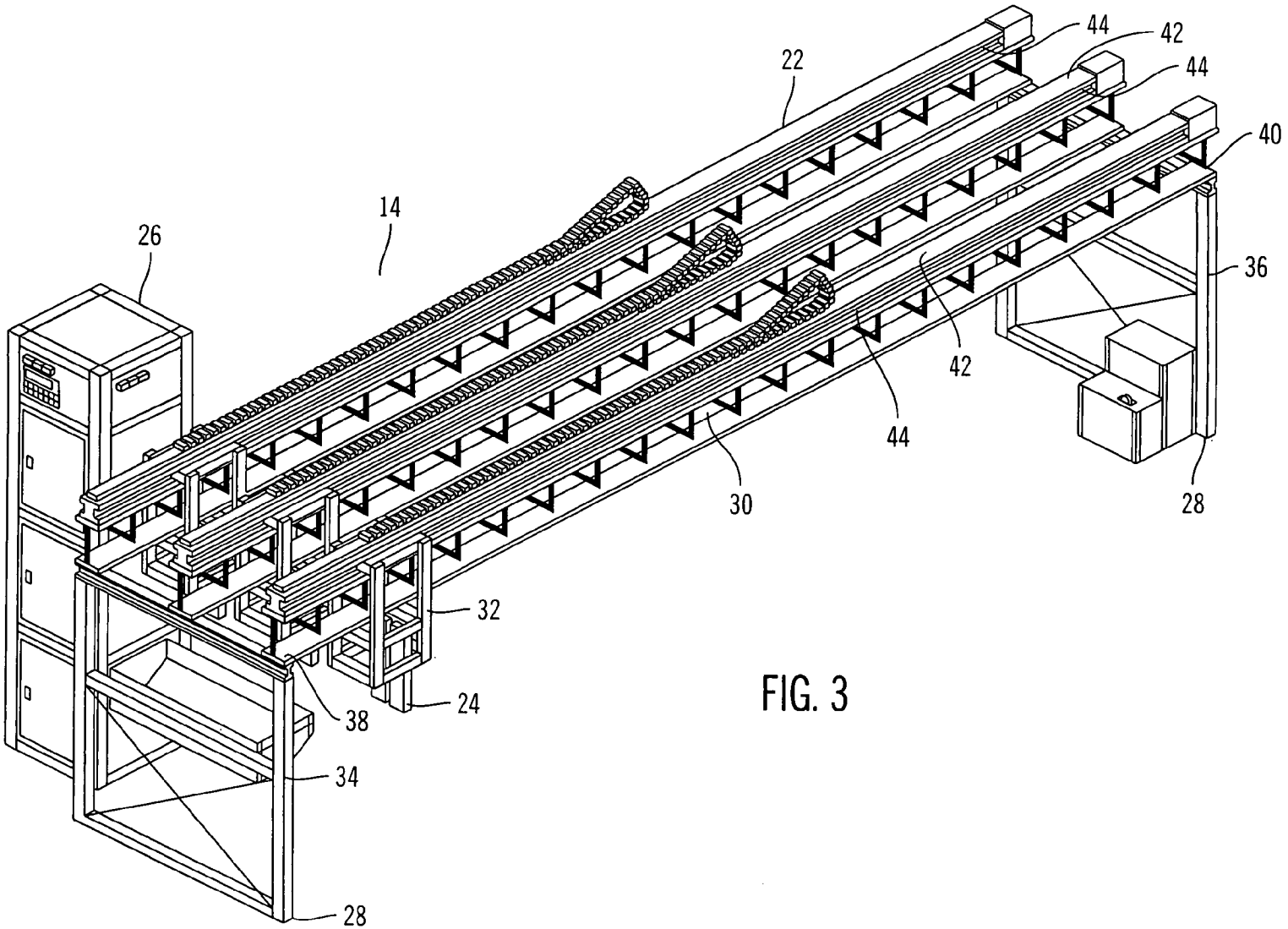
FIG. 3 is a stationary print platform in accordance with the embodiment of FIG. 2.

With reference to FIG. 3, the stationary print platform 22 comprises a plurality of support members 28, a horizontal member 30, and a scanning support member 32. The plurality of support members 28 comprise a first support member 34 and a second support member 36, wherein the first support member 34 is placed a distance apart from the second support member 36 such that a passageway is formed therebetween. The support members 28 are made from aluminum, metal alloys, or any other material capable of supporting the horizontal member 30 and the scanning member 32, as discussed below.

The horizontal member 30 comprises a first end 38, a second end 40 and a horizontal track 42, wherein the first end 38 is coupled to the first support member 34 and the second end 40 is coupled to the second support member 36. When the horizontal member 30 is coupled to the first 34 and second support members 36, a rectangular arch, or inverted sharp-edged U is formed. The horizontal track 42 comprises a groove 44 that extends between the first end 38 and the second end 40.

Figure 4:
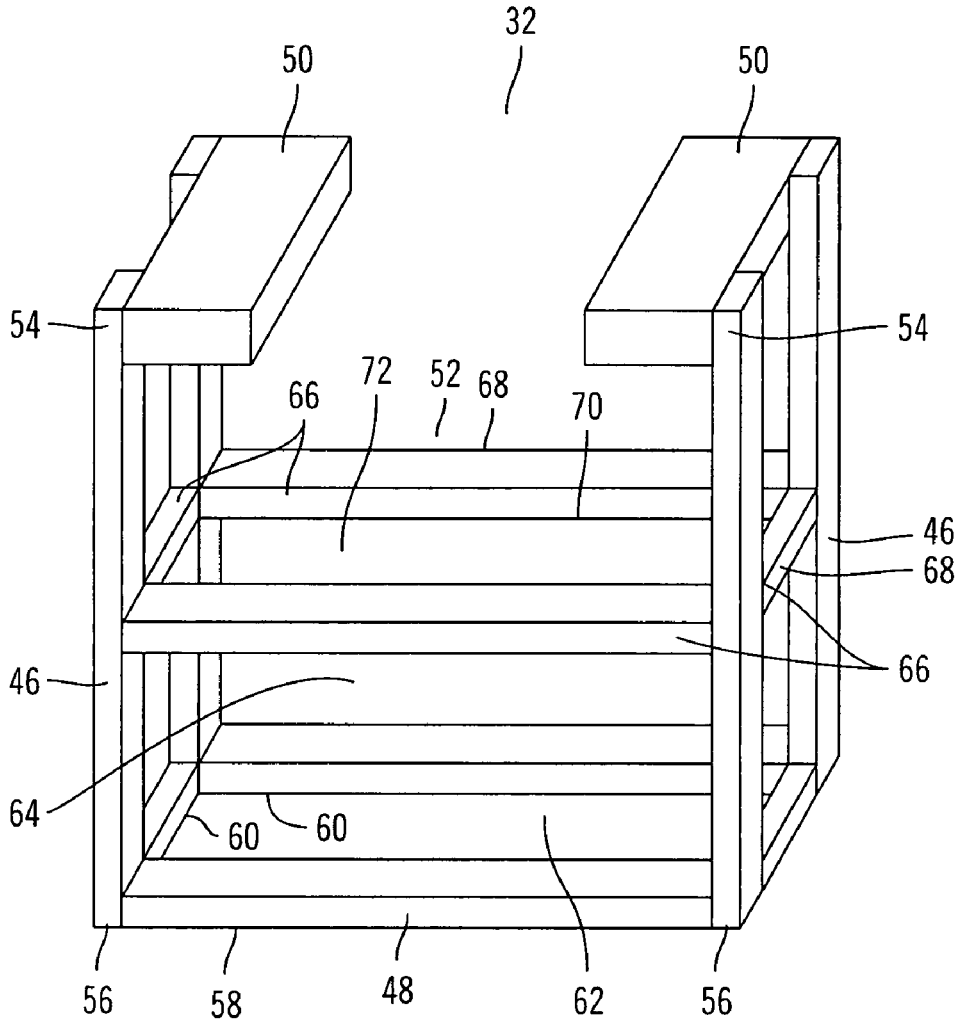
FIG. 4 depicts a scanning member in accordance with the embodiment of FIG. 2.

The scanning support member 32 is coupled to the horizontal member 30. With reference to FIG. 4, the scanning support member 32 comprises side members 46, a bottom member 48, edge members 50, and a scanning support platform 52. The side members 46 are vertical members having a first end 54 and a second end 56, wherein the second end 56 is perpendicularly coupled to the bottom member 48. The bottom member 48 comprises an outer perimeter 58 and an inner perimeter 60, wherein the outer 58 and inner perimeter 60 form a square shape defining an aperture 62 in the center. The joining of the side members 46 and the bottom member 48 form a square U-shaped member having a hollow interior 64.

The edge members 50 are coupled to the first end 54 of the side members and project inwardly toward the hollow interior 64. The edge members 50 are configured to mate with the groove 44 of the horizontal track such that the scanning support member 32 freely hangs from the horizontal member 30.

The scanning support platform 52 comprises a plurality of horizontal bars 66 that form a square having an outer perimeter 68 and an inner perimeter 70, wherein the inner perimeter 70 defines a hollow interior 72. The horizontal bars 66 are positioned in-between the side members 46 such that the scanning support platform 52 is parallel to, but resides above, the bottom member 48. The hollow interior 72 of the scanning support platform 52 coincides, in whole, or in part, with the hollow interior 64 of the scanning support member 32 and aligns with the aperture 62 of the bottom member 48.

With reference to FIG. 3, the print head 24 is coupled to the scanning support member 32 and resides within the hollow interior 64 and through the aperture 62 of the bottom member 48. The print head 24 is coupled to the scanning support platform 52 of the scanning support member 32. In preferred embodiments, the print head 24 is an ink jet print head that prints on demand. The print head 24 is capable of printing from 15-18 inches from the target print media without compromising the integrity of the print quality. In preferred embodiments, the print head has six (6) colors. It is to be understood that the above description is not intended to limit the type of print head used in the system. Indeed, any type of print head capable of printing in a scanning manner may be suitable for use in the printing system, including, but not limited to spray guns and piezoelectric print heads.

With reference again to FIG. 3, the processor 26 is a computer, such as, but not limited to, a personal computer, a stand alone main frame, a network system, a lap top computer or any combination thereof. The processor is in electronic communication with the scanning support member 32 and directs the scanning support member 32 to move back and forth, thereby moving the print head 24. In addition, the processor 26 is in electronic communication with the print head 24 and instructs the print head 24 in printing the image onto the substrate 15 as the substrate passes below the stationary print platform 22.

Figure 5:
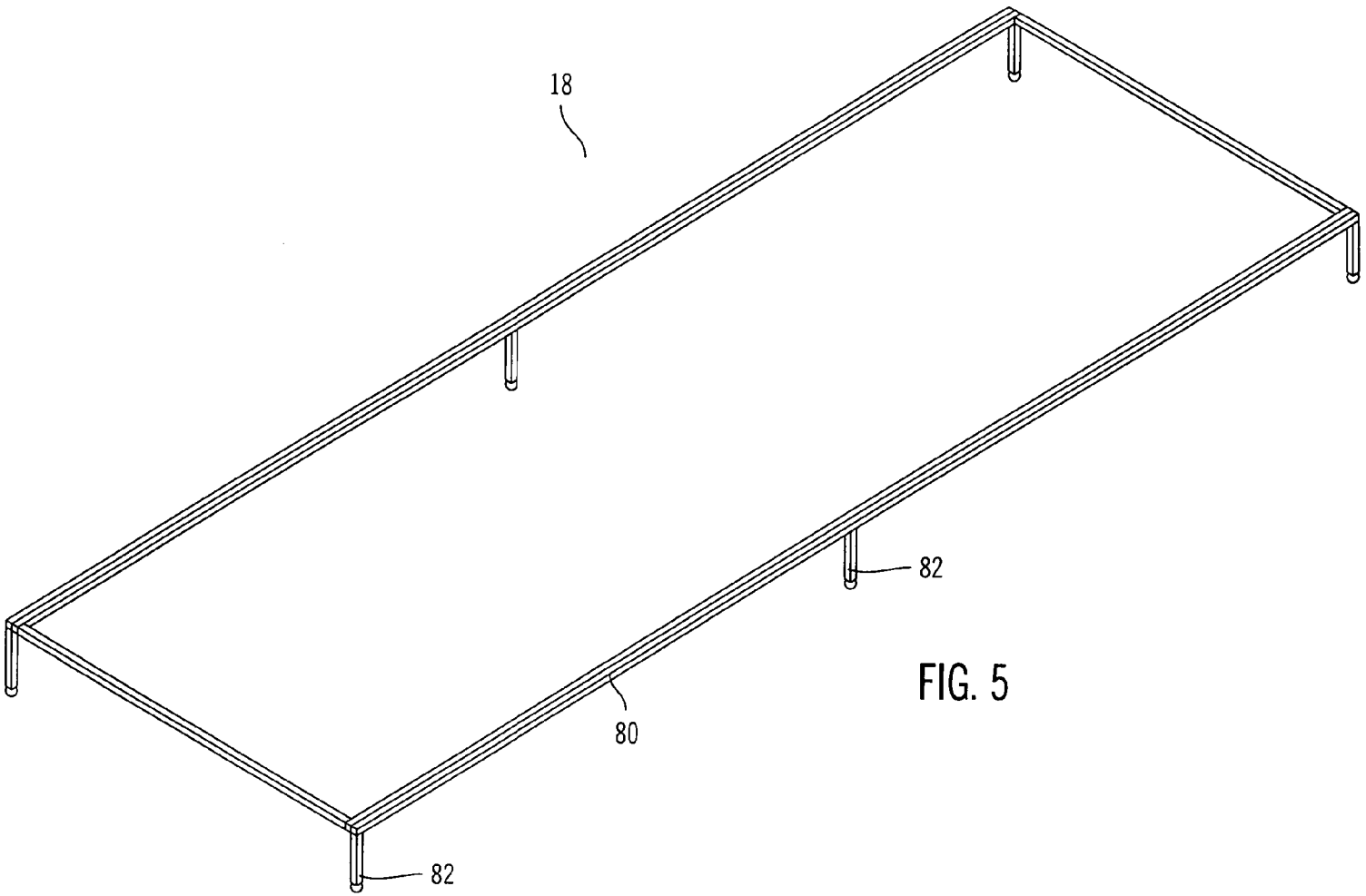
FIG. 5 is a platform for supporting the print substrate in accordance with the embodiment of FIG. 2.

With reference to FIG. 5, the platform 18 comprises a hollow frame 80 with leg members 82, and a plurality of securing devices 83 (FIG. 6), wherein the leg members 82 are perpendicularly coupled to the frame 80. The frame 80 is configured to received an oversized print substrate.

In preferred embodiments, the frame 80, or platform bed, is approximately 20' (w)×60' (l) in size, wherein the frame 80 can accommodate any print substrate up to this size. It is to be understood that the frame 80 size can be varied and is only limited by the width of the print platform 22.

The leg members 82 are approximately 25-35" in height, wherein the height can vary depending upon the height requirements of the print platform 22. The leg members 82 elevate the frame 80 to a height that allows the frame 80 to pass under the print head 24 on the horizontal member of the print station 14, but that is sufficiently close to the print head for optimal printing.

Figure 6:
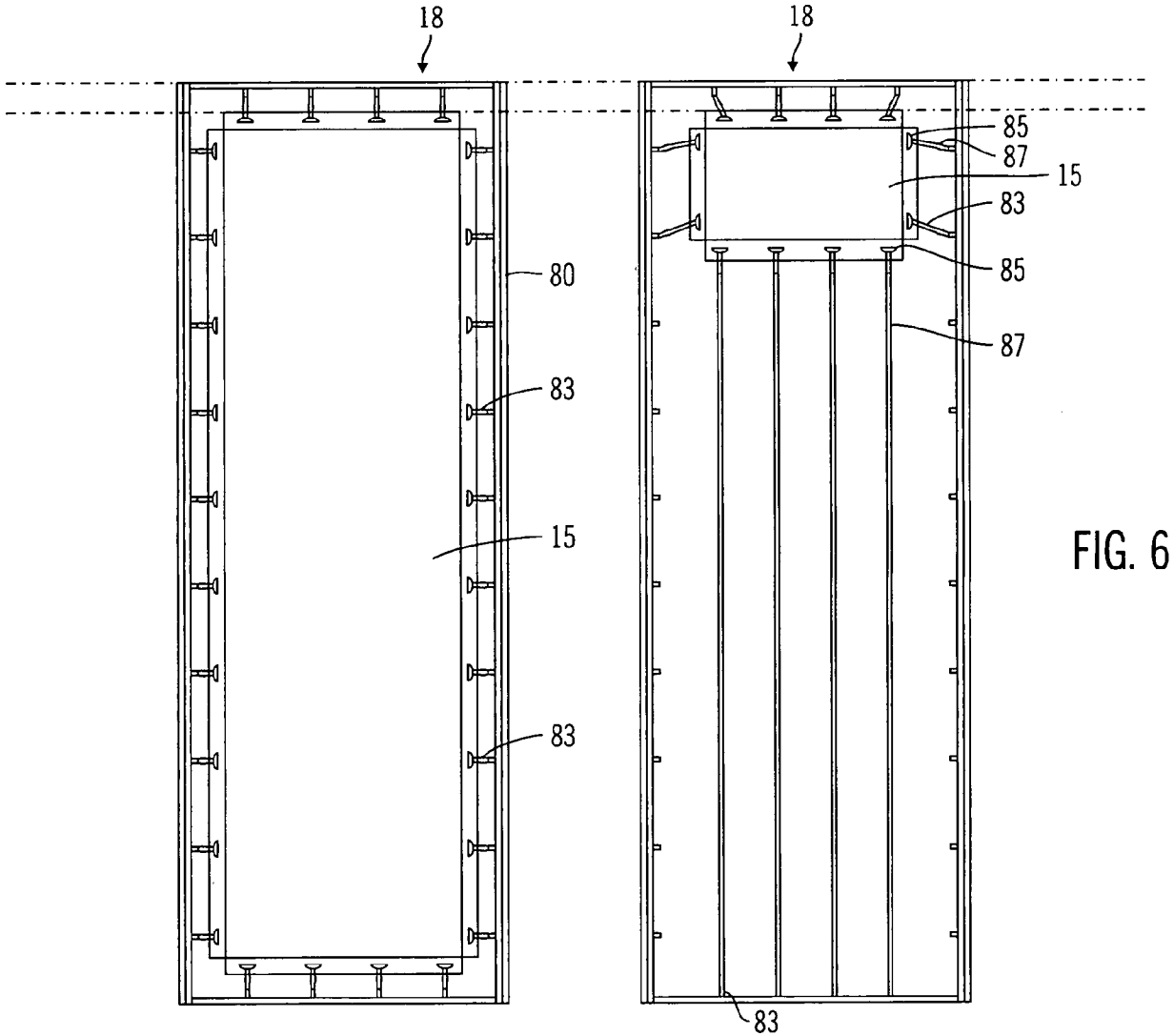
FIG. 6 is a top perspective of two platforms having varying sizes of substrates attached in accordance with the embodiment of FIG. 5.

With reference to FIG. 6, the securing device 83 comprises a clamping device 85 and an expandable member 87. The clamping device 85 can be hooks, rings, bars or any suitable mechanism that can grab the print substrate or be threaded through an opening in the print substrate. The clamping device 85 secures to the print substrate 15 which has been stretched onto the platform 18 and stretches the print substrate 15 taut. The expandable member 87 of the clamping devices 85 is adjustable such that a print substrate smaller than the frame 80 can be secured to the platform 18.

As most billboard sizes are 14'×48', the platform 18 is designed to support a substrate large enough to print an entire image for a billboard in a single printing pass, wherein the substrate includes the coupling members or borders 6 used for later attachment to the billboard. The platform 18 is sized so that it can pass through the passageway of the first and second support members 34, 36 of the printing station 14. The platform 18 is made from aluminum or steel, although material, including, but not limited to, wood, plastic, and metal alloys are suitable.

Figure 7:
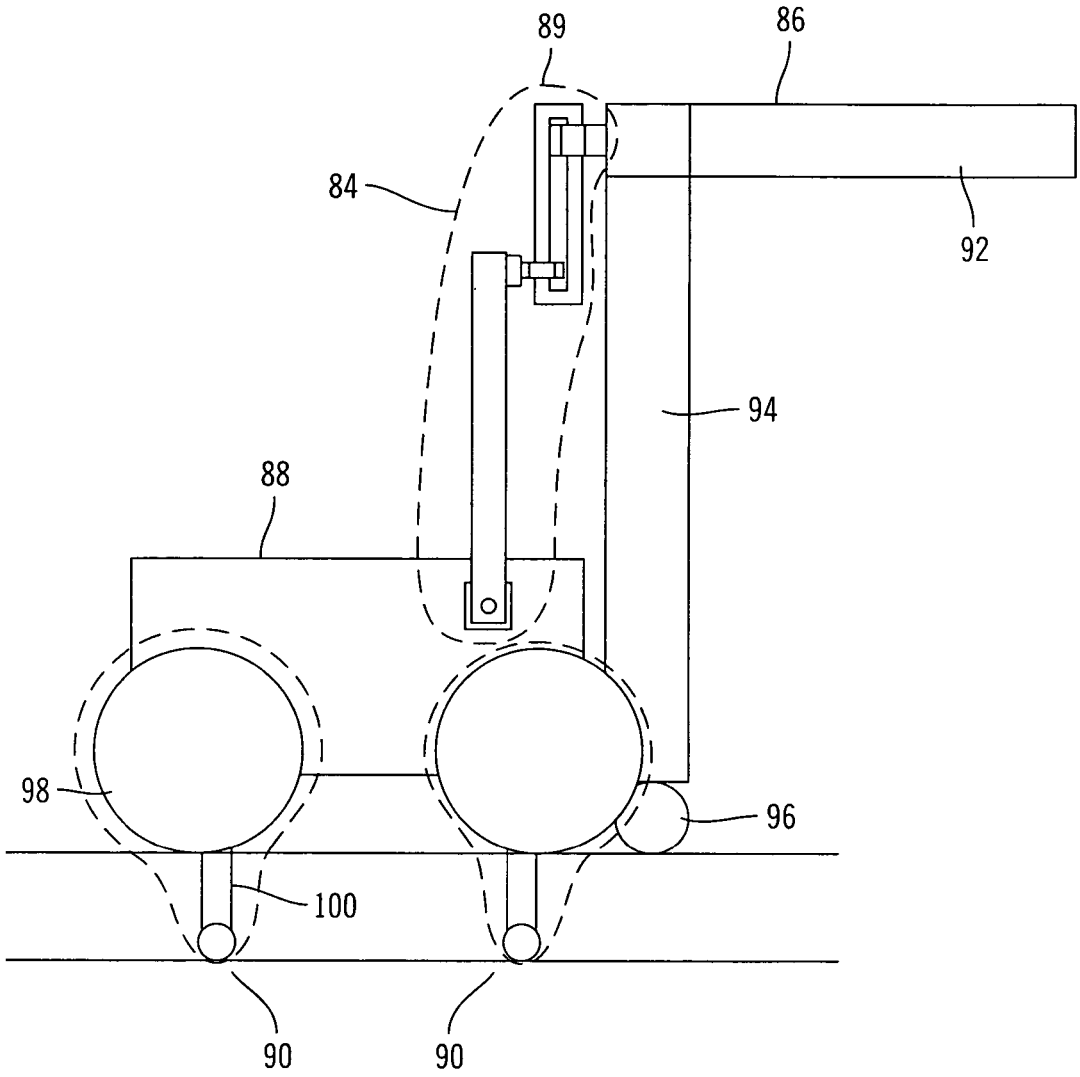
FIG. 7 is a side perspective of a transport mechanism in accordance with the embodiment of FIG. 2.

The transportation system 20 comprises a transport mechanism 84 and a track 21, wherein the track 21 is a predefined pathway for the travel of the frame 80. With reference to FIG. 7, the transport mechanism 84 comprises a driving member 86, a power supply 88 and a guidance system 90 (partially shown). The driving member 86 comprises a push bar 92, a vertical member 94 and a roller 96. The push bar 92 is rectangular or square in shape, and is at least as wide as the transport mechanism 84, although it can be wider or smaller than the transport mechanism 84. The push bar 92 is configured to coincide with the frame 80 during operation and thus is elevated no higher than the frame height.

Figure 8:
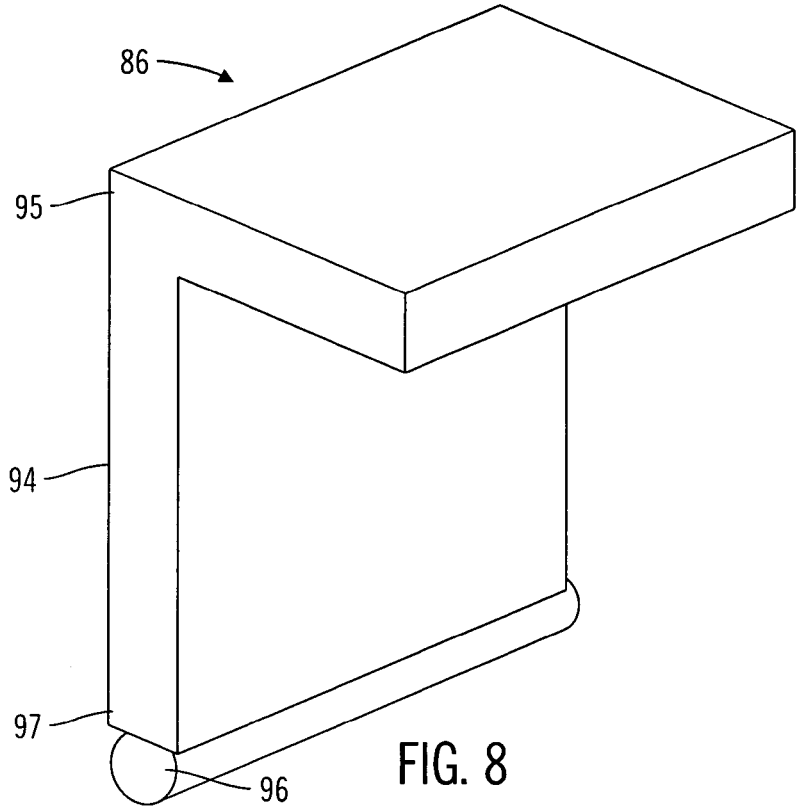
FIG. 8 is a perspective of a driving member having a solid vertical support in accordance with a preferred embodiment of the present invention.
Figure 9:
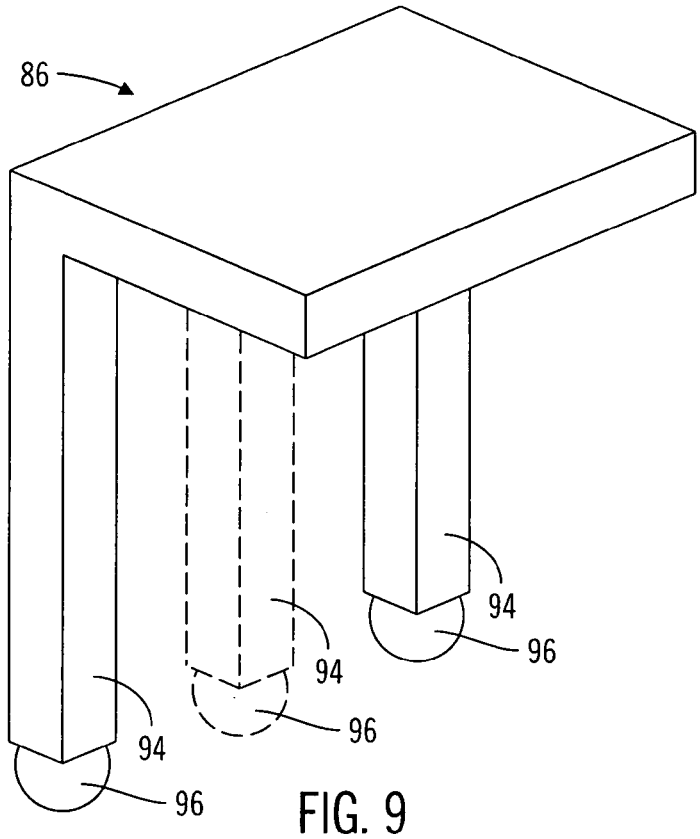
FIG. 9 is another perspective of a driving member having a plurality of vertical supports in accordance with a preferred embodiment of the present invention.

With reference to FIG. 8, the vertical member 94 comprises a first end 95 and a second end 97, wherein the push bar 92 is coupled to the first end 95 such that an inverted L-shape is formed. The vertical member 94 is a single rectangular support that extends along the width of the driving member 86. With reference to FIG. 9, in other preferred embodiments, a plurality of vertical members 94 are coupled at both ends of the driving member 86 as pillar type supports. Still in another preferred embodiment, additional vertical members 94 are coupled to the driving member 86 in various positions (see dotted vertical member 86 in FIG. 9).

A roller 96 is coupled to the second end 97 to provide support to the driving member 86 during the movement of the transport mechanism 84. The roller 96 can be one single elongated cylinder that extends along all (FIG. 8) or a portion of the width of the driving member 86, or can be a series of individual wheel members placed along the width of the driving member 86 (not shown). If a plurality of vertical members 94 are coupled to the driving member 86, each vertical member could have its own roller (FIG. 9). In some embodiments, the roller 96 is not included in the driving member 86.

With reference again to FIG. 7, the driving member 86 is coupled to the power supply 88 via a coupling device 89. The coupling device 89 is a set of bars or rods that are capable of supporting the driving member 86 in an extended position from the power supply 88. The bars are coupled together via clamps and screws, or any means suitable for securing the bars to each other. The coupling device 89 is secured to the power supply 88 and the driving member 86 such that the driving member 86 is coupled to the power supply 88. It is to be understood that any means of coupling the driving member 86 to the power supply 88 that can support and stabilize the driving member 86 is suitable. It is to be further understood that the driving member 86 can be coupled to any other suitable portion of the transport mechanism 84, and the configuration is not intended to be limited by this description.

The power supply 88 provides power to the transport mechanism 84 for linear movement along the transportation system 20. The power supply 88 is a motor having at least 3-5 horsepower (HP), although any means capable of providing sufficient power to move the frame 80 and print substrate 15 is suitable.

Figure 10:
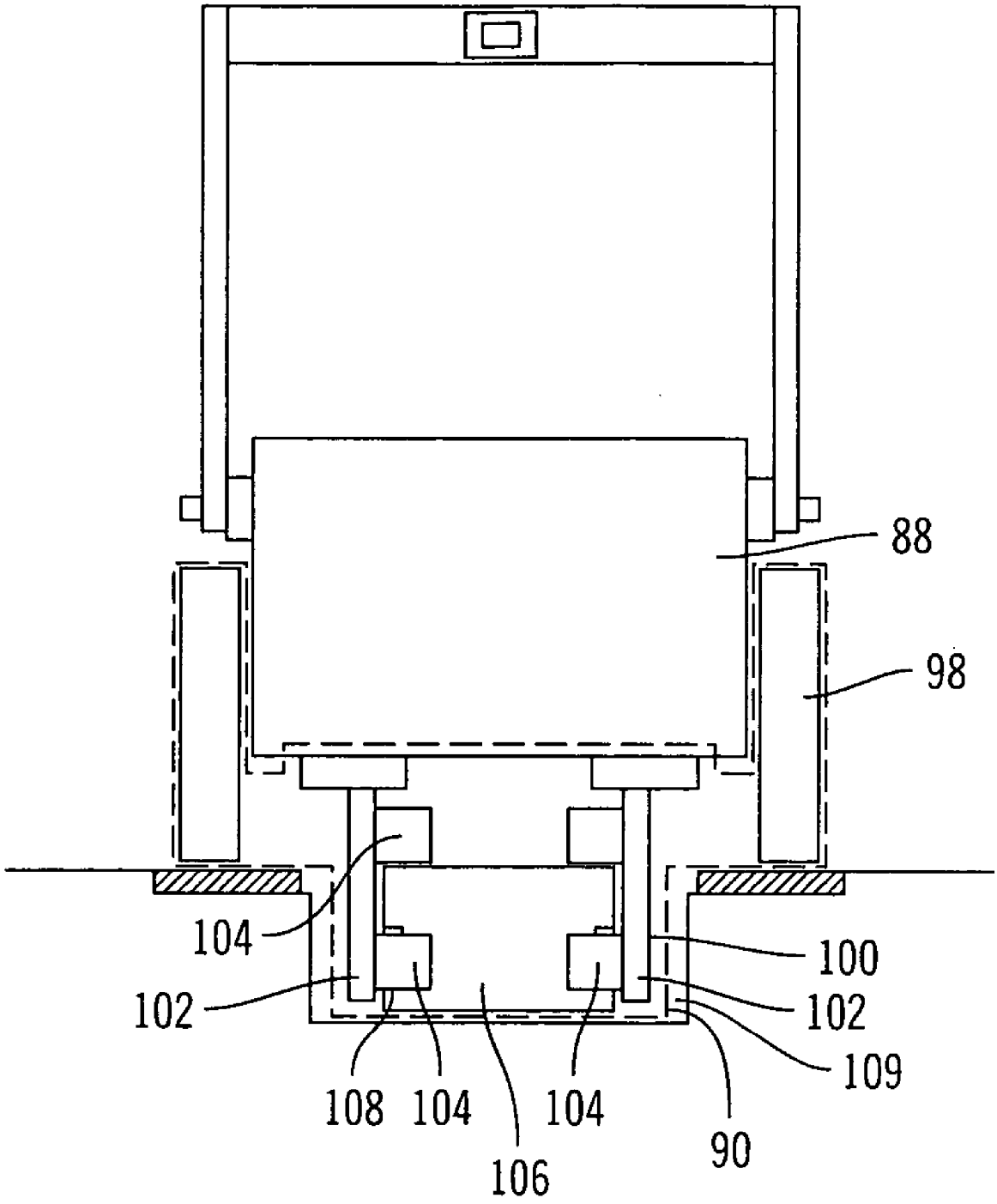
FIG. 10 is a back perspective of a transport mechanism in accordance with the embodiment of FIG. 2.

With reference to FIG. 10, the guidance system comprises rollers 98 and guiding members 100. The rollers 98 reside adjacent the power supply 88. In one preferred embodiment, the guidance system comprise four rollers 98, wherein two rollers 98 are placed on either side of the power supply 88. The rollers 98 are large enough in diameter to support the transport mechanism 84 and are made from rubber, or other suitable materials. Although the illustrated embodiment depicts rollers 96, it is to be understood that any suitable device or mechanism for transporting the transport mechanism 84 is suitable.

The guiding members 100 each comprise a vertical support 102 and projections 104. The vertical support 102 is coupled to the power supply 88 and extend in a downwardly towards the track 21 of the transportation system 20. In preferred embodiments, a guiding member 100 corresponds to each roller 98.

The projections 104 are coupled to the vertical support 102 and extend perpendicularly therefrom. The vertical supports 102 are positioned parallel to each other and the projections 104 extend inwardly such that the projections 104 reside between the vertical supports 102.

The track 21 of the transportation system comprises a rail member 106 having grooves 108 that extend along the length of the rail member 106. The grooves 108 are configured to receive the projections 104 of the guiding members 100.

The guidance system 90 operates in conjunction with the track 21 of the transportation system 20. The guiding members 100 releasably couple to the track 21 such that one of the projections 104 from each guiding member is received in a groove 108 and the remaining projection 104 for each guiding member is disposed along the top of the rail member 106. This coupling aids in the guidance of the transport mechanism 84.

The track 21 is disposed within a channel 109 that can accommodate the rail member 106, vertical supports 102 and projections 108. In one preferred embodiment, the channel 109 forms an oval shape comprising two linear portions and two arc sections. The oval shaped channel 109 can include at least two printing stations 14 with the arc sections as pathways there between, wherein the arc sections facilitate the transport of the platforms 18 between printing stations 14. In this manner, the platforms 18 can be utilized on multiple printing stations 14, wherein a transport mechanism 84 on one track 21 can be utilized to move the platform 18 and print substrate 15 to a parallel track 21. It is to be understood that any design of the channel 109, and therefore the tracks 21, are possible, including, but not limited to parallel linear tracks that are not joined.

The transportation system 20 is configured to transport the platform 18 from station to station. Further, the transportation system 20 is configured to vary the speed of the platform 18. In particular, the platform 18 is slowed during printing as the platform 18 is incrementally moved between each printing scan. In one preferred embodiment, the platform bed is moved 15 cm at a time, wherein the six colors on the print head reside within the 15 cm. It is to be understood that any incrementation which allows for the printing of the image on the substrate in accordance with the limitations of the print head is suitable.

Figure 11:
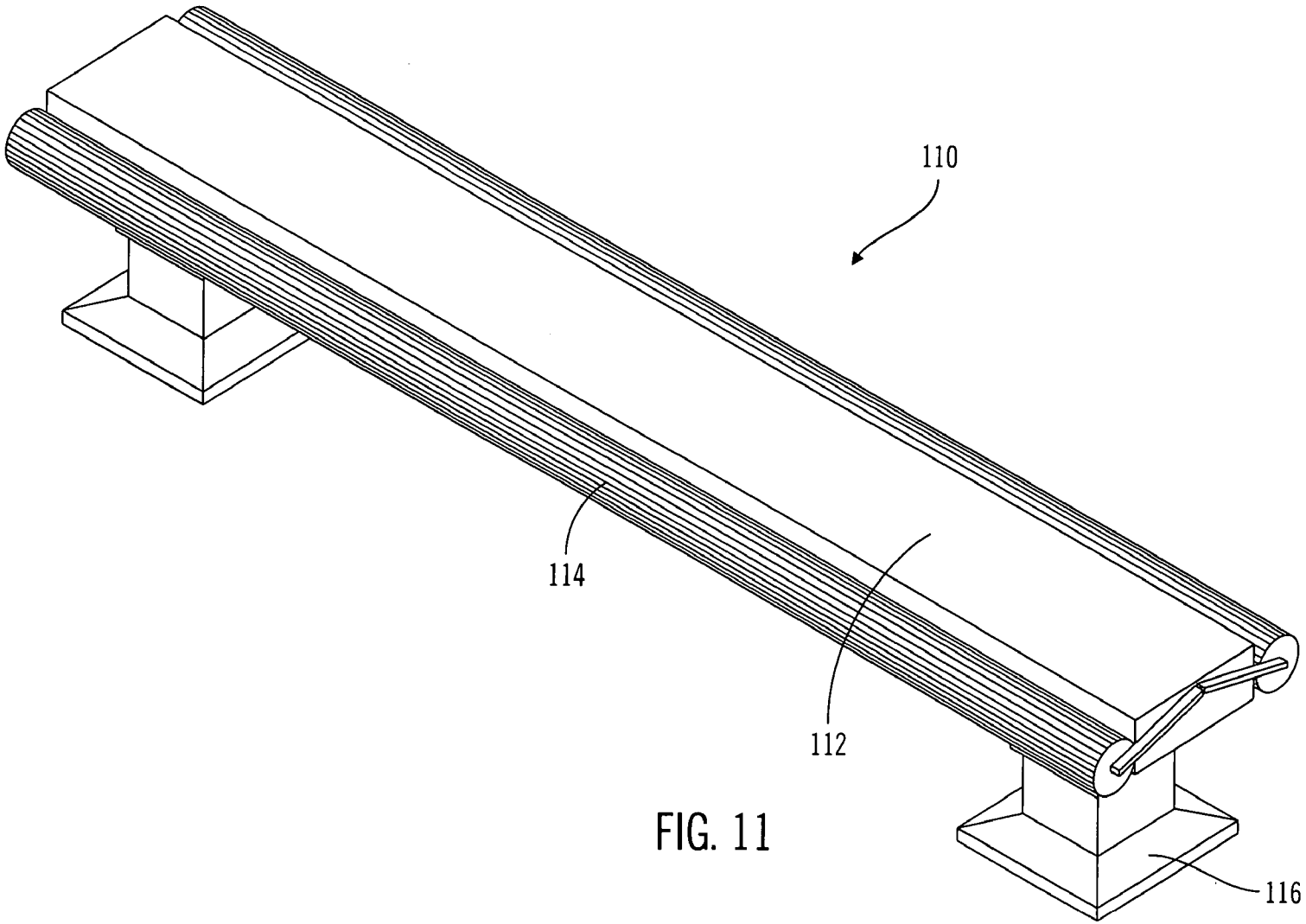
FIG. 11 is a smoothing device in accordance with a preferred embodiment of the present invention.

With reference to FIG. 11, the smoothing device 110 comprises a horizontal bed 112, rollers 114 and expandable supports 116. The horizontal bed 112 is a flat rectangular surface. The horizontal bed 112 is smooth and is made from steel, aluminum or any other materials that provide a smooth surface. The horizontal bed 112 is configured to fit the width of the largest print substrate 15 that the printing system is designed to accommodate. In one preferred embodiment, the horizontal bed 112 is approximately 3' (w)×60' (l) in size.

The rollers 114 are disposed adjacent the length of the horizontal bed 112 and reside parallel thereto. The surface of the rollers 114 are ridged to aid in the rotation of the rollers 114 as material is passed over the rollers 114. In some embodiments, the surface of the rollers 114 is smooth, wherein the contact tension between the material and the rollers 114 is sufficient to cause rotation in the rollers 114. In one preferred embodiment, the rollers 114 are manually operated in that the rollers 114 rotate in response to material being pulled across the roller surface. In another preferred embodiment, the rollers 114 are powered and remain in constant rotation during the operation of the system.

Figure 12:
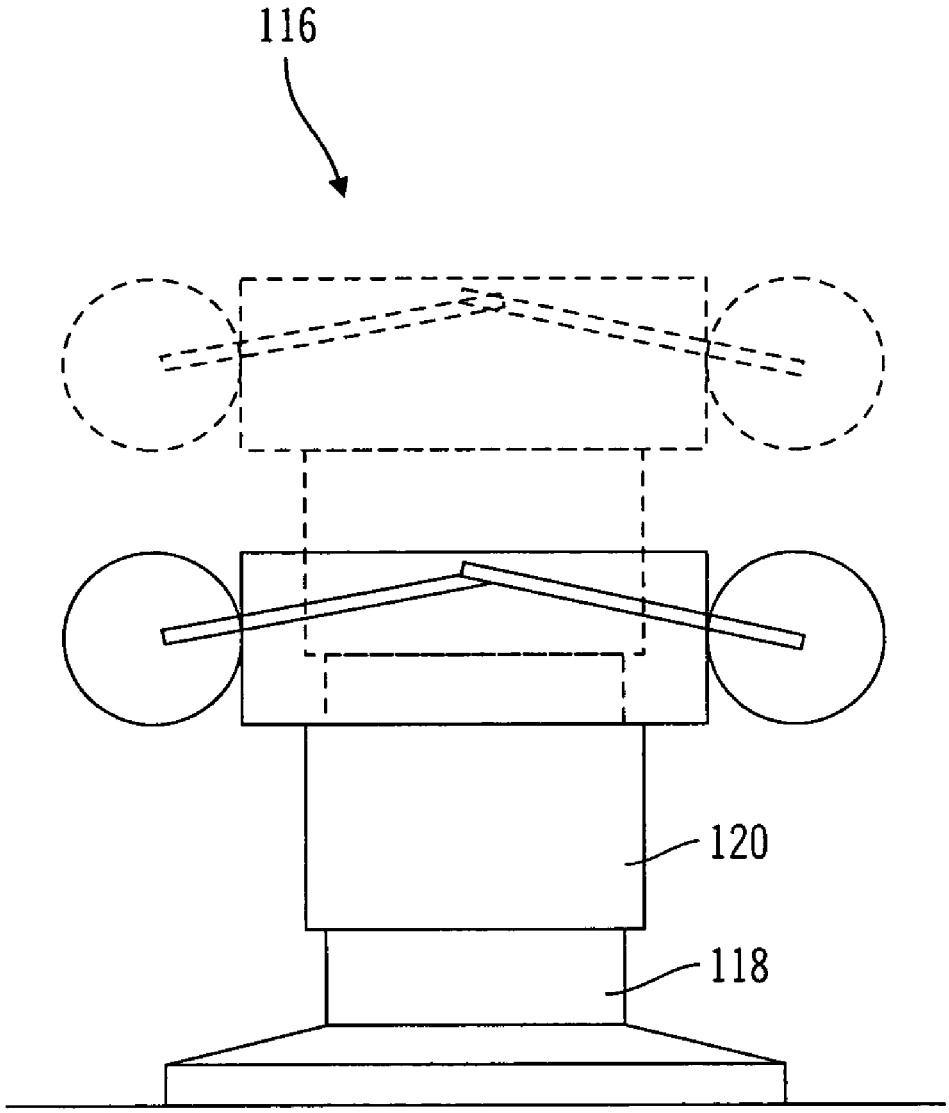
FIG. 12 is a side perspective of the smoothing device in a collapsed and expanded position in accordance with the embodiment in FIG. 11.

The expandable supports 116 are disposed at the ends of the horizontal bed 112. With reference to FIG. 12, the expandable supports 116 comprise a first and second telescopic sections 118, 120 wherein the diameter of the first telescopic section 118 is smaller than the diameter of the second telescopic section 120. As such, the first telescopic section 118 collapses inside the second telescopic section 120.

The expandable supports 116 further comprise a sensor (not shown) and a mechanism to expand the telescopic sections 118, 120. The mechanism to expand the telescopic sections 118, 120 resides within the expandable supports 116 and is not shown in the figures. In one preferred embodiment, the mechanism to expand the telescopic sections is a hydraulic lift, although any other means capable of raising and lowering the horizontal bed 112 is suitable, including, but not limited to, a pulley system, a manual jack and a pump device.

Figure 13:
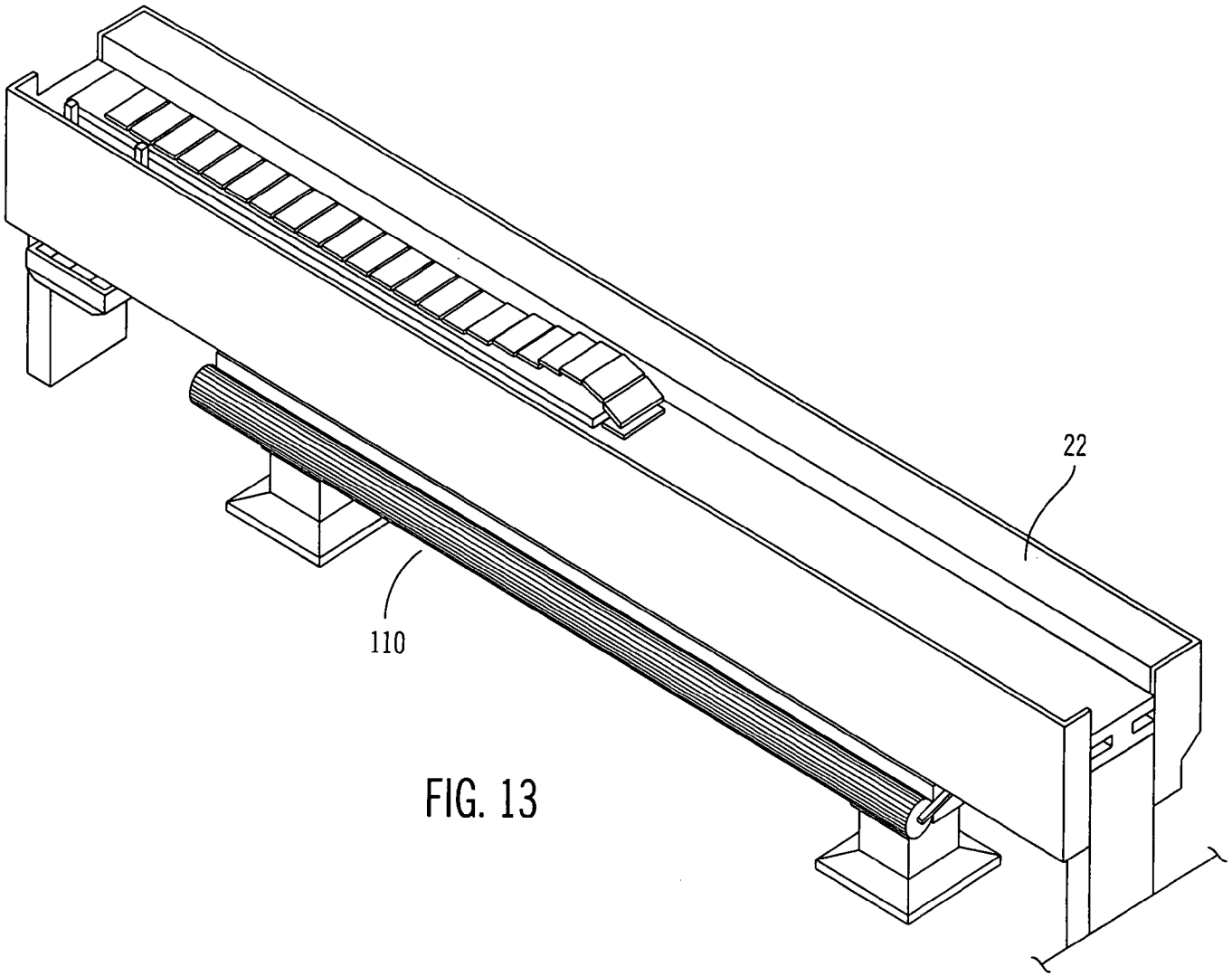
FIG. 13 is perspective view of the smoothing device in operation with the stationary printing platform in accordance with the embodiment of FIG. 11.

The sensor is in electronic communication with the hydraulic lift and transmits a signal to the hydraulic lift to engage and raise the horizontal bed 112. Upon receipt of the signal from the sensor, the expandable supports 116 are raised to a predetermined height. With reference to FIG. 13, the smoothing device 110 is positioned underneath the print platform 22 during operation. It is to be understood that any means of causing the expandable supports to elevate in conjunction with the substrate passing under the print station is suitable.

In operation, with reference again to FIG. 2, prior to the loading of a print substrate 15, a slidable support 19 is placed underneath the frame 18. The slidable support is rectangular or square in shape and is sized to fit underneath the platform 18 such that a horizontal surface is provided for the otherwise hollow frame 80. A print substrate 15 is then placed upon the horizontal surface of the slidable support 19 and secured to the platform 18 via the securing devices 83.

Figure 1:
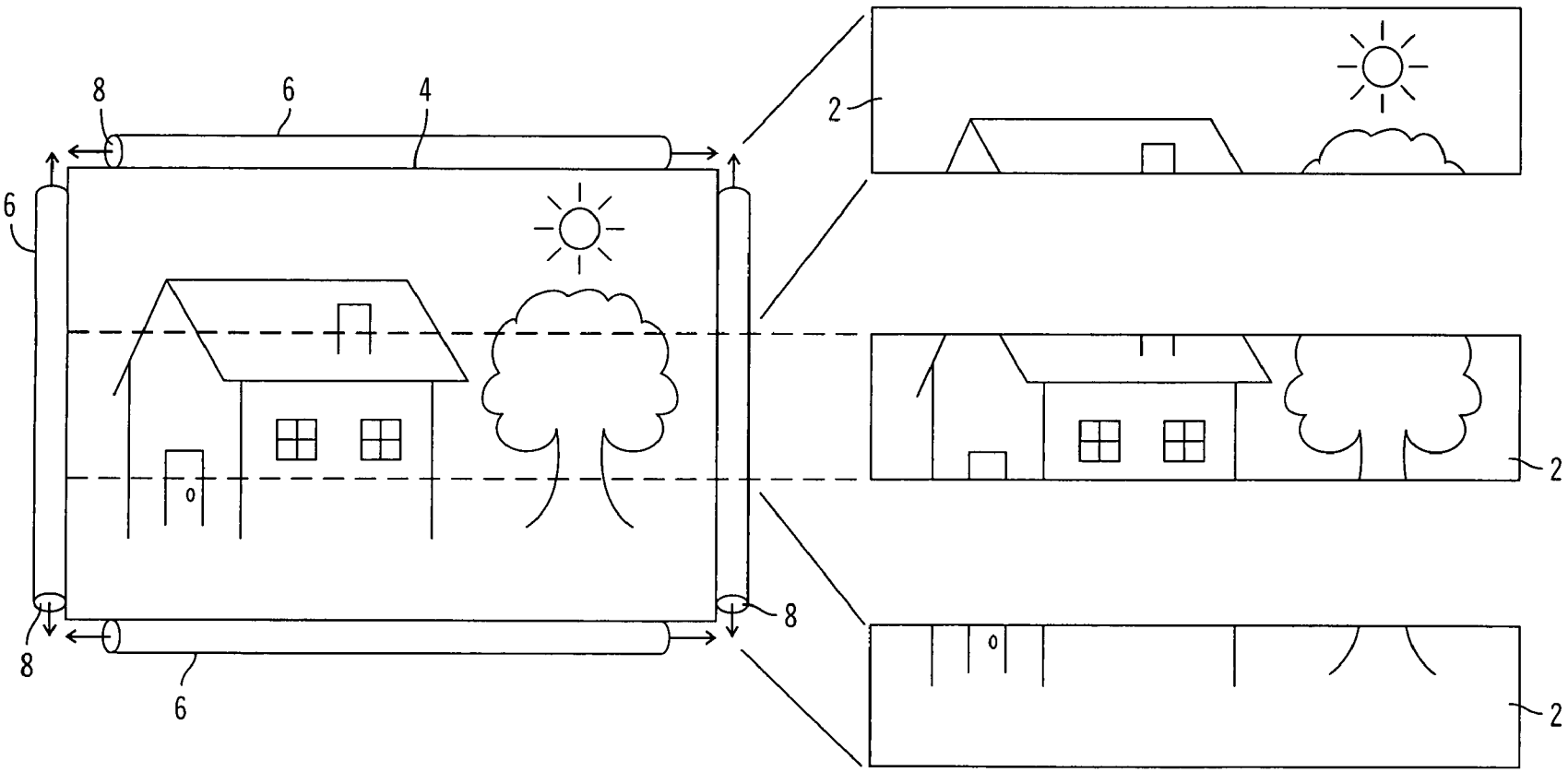
FIG. 1 depicts a printed image having borders, wherein the image is assembled from separately printed and seamed together segments.

Once the print substrate is secured to the platform 18, the slidable support 19 is removed. The transport mechanism 84 is then engaged such that it begins pushing the platform 18 along the track 21, wherein the push bar 92 contacts the frame 80. In one embodiment, a second transport mechanism 85 (FIG. 1) is positioned in front of the platform 18. The second transport mechanism 85 is pushed along with the platform 18 as the frame 80 contacts the push bar 92 of the second transport mechanism 85. In some embodiments, the push bar 92 includes a coupling mechanism whereby the push bar 92 can grab the frame 80 and pull it along the track 21. It is to be understood that the push-pull of the two transport mechanisms 84, 85 would be coordinated so as not to affect the printing of the image on the substrate. Further, in other embodiments, only the transport mechanism 85 that pulls the platform 18 is utilized during printing.

Figure 14:
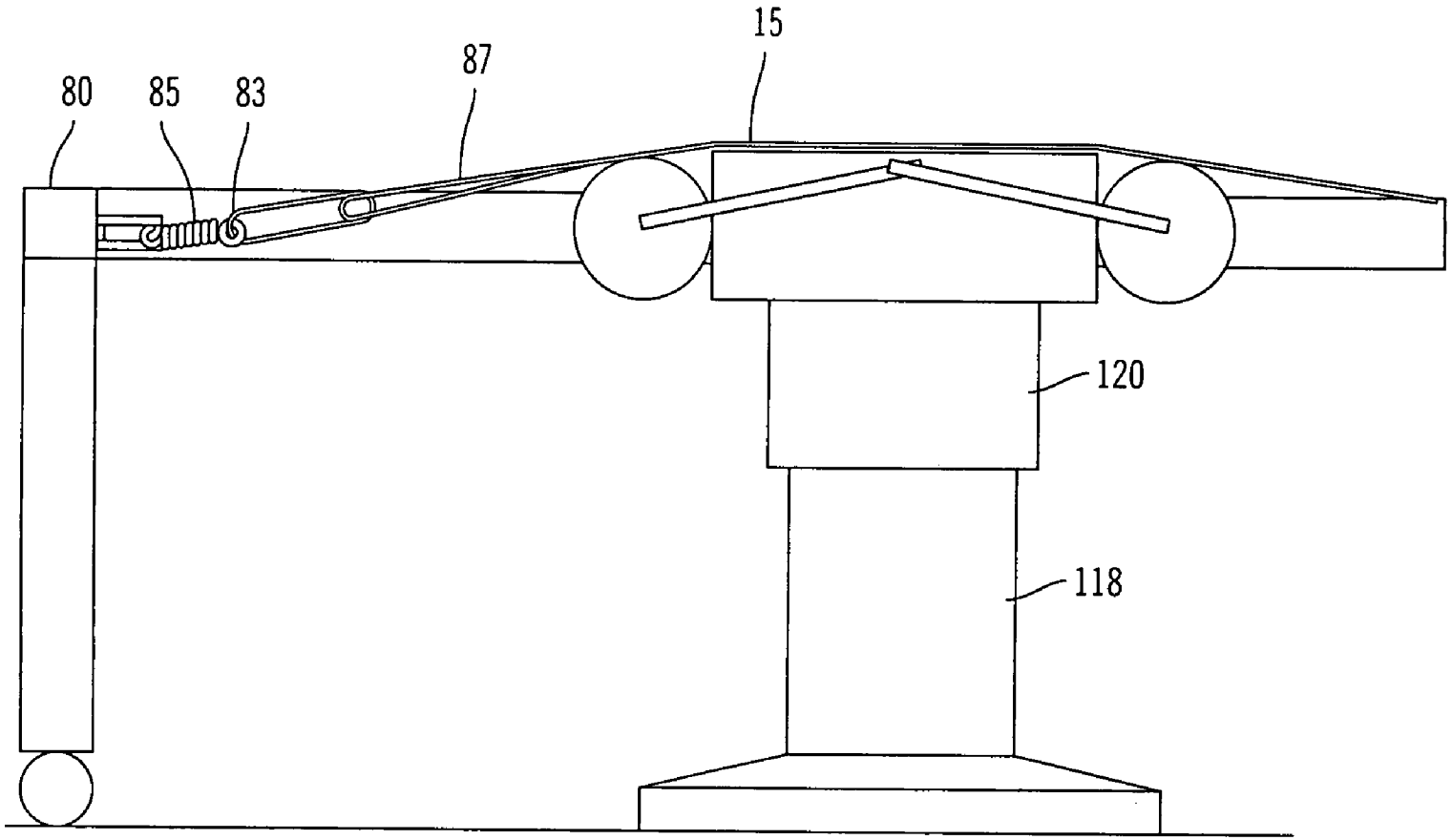
FIG. 14 is a side perspective of the smoothing device in operation with the platform for supporting the print substrate in accordance with preferred embodiments of the present invention.

As the platform 18 approaches the print platform, the sensor, which is located in any position that is capable of sensing the approach of the platform 18, transmits a signal to the hydraulic lift which then raises the horizontal bed 112. With reference to FIG. 14, as the platform 18 passes under the print head 24, the substrate is stretched over rollers 114 and onto the horizontal bed 112. The height of the horizontal bed 112 is higher than the height of the frame 80, thus, the substrate is stretched flat and taut as it passes under the print head. The tautness of the print substrate facilitates accurate and consistent printing of the image on the print substrate 15, thereby reducing inconsistencies in the printing and loss of integrity in the printed image.

After the entire print substrate passes under the print head 24, the substrate is moved to the unloading area where the printed substrate is unloaded, packaged and sent to the client. If the track is oval, as in FIG. 1, the platform 18 can be pushed to the loading area of the parallel track, wherein it is loaded for printing. It is to be understood that the platform 18 can also be pushed in the opposite direction on the same track via the transport mechanism 85 that had previously traveled in front of the platform 18. In this manner, only a single printing station 14 is utilized despite the ability to move the platform 18 to the parallel track.

In embodiments having a single track or an unconnected parallel tracks, the transport mechanism 85 that has been in the front of the platform 18 during this printing operation transports the platform 18 back to the loading station. In some preferred embodiments, the unloading station also serves as a loading station, wherein a new print substrate 15 is loaded onto the platform 18. The print substrate 15 is then transported along the track 21 in the opposite direction and is printed. In this manner, the system can be used more effectively as printing can be accomplished in both directions.

It is to be understood that variations of the above described system exist. For instance, the number of transport mechanisms vary as can the number of parallel tracks. Further, a plurality of platforms can be added to each track such that multiple printing jobs can be accomplished on a single print head. In this regard, the expense for the system is reduced as the cost of a frame is substantially less than the cost for a print station. Additionally, a track between two parallel printing stations 14 can be included (FIG. 1, dotted lines), wherein the loading for both tracks can utilize a single slidable support 19.

The above described system allows for the efficient printing of oversized media as the entire image can be printed in one pass of the print station due to the oversized platform bed and span of the printing platform. However, further efficiencies are realized in embodiments of this system due, in part, to the process of printing the oversized media.

Figure 15:
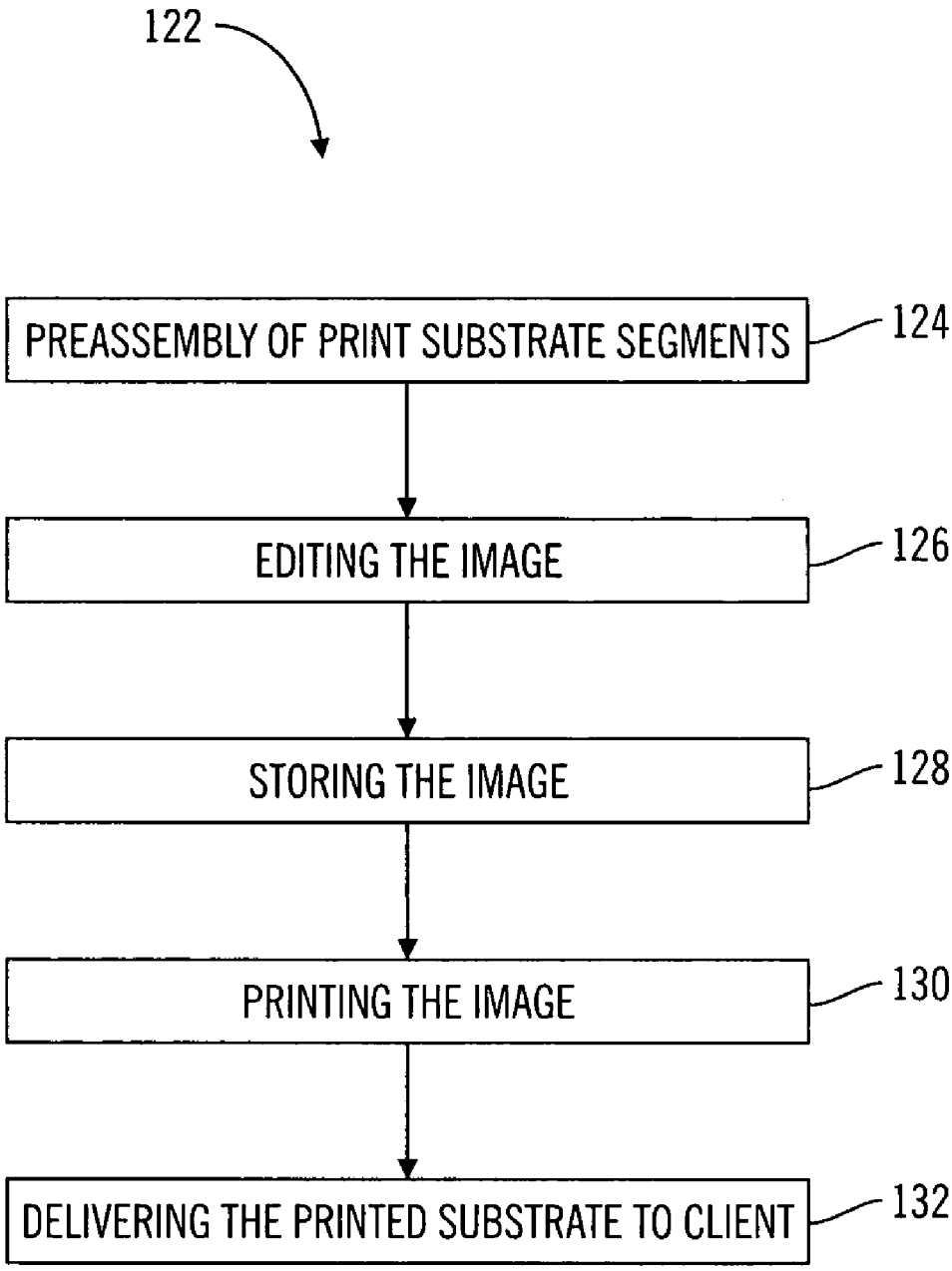
FIG. 15 is a flowchart of a process of printing oversized substrates in accordance with a preferred embodiment of the present invention.

With reference to FIG. 15, embodiments of the process 122 for printing oversized substrates, comprise preassembling print substrate segments 124, editing the image 126, storing the image 128, printing the image 130, and delivering the printed substrate 132 to the client.

The preassembly of the print substrate segments 2 require the retrieval and assembly of precut segments 2. The segments 2 are standard size print substrates commonly used in current flatbed printing systems. Typically, the segments are 54"×48'. The segments 2 can be precut and stored flat on top of each other, or can be stored on a roll and cut as needed during the preassembly process.

The preassembling of print substrate segments 124 comprises the coupling of segments and the coupling of an attachment member. The coupling of segments is a binding or seaming process whereby the segments are joined together to create a single print substrate. In one embodiment, 4 segments are placed parallel to each other with an overlay of approximately a 2" overlap. The segments are each 54"×48'. A bonding substance, such as, glue or other adhesion, is applied between the overlayed portions. The overlayed portions are then pressed together to bond the two segments. The seamed portions between each of the plurality of printing segments increases the height of the material by at least twice that of the other portions of each printing segment as the seamed portion is an overlay of sections of two printing segments. The bonding process is performed for each of the adjacent segments until one single print substrate is created.

In another preferred embodiments, a strip of substrate material is placed over the abutting sides of each of the individual segments. The strip has a bonding substance, such as, glue, on the side in contact with the substrate segments. In this manner the strip couples the adjacent segments. Irregardless of the manner in which the segments are seamed together, the height of the material along the seam is at least twice as high as the height of the remaining portions of the segments.

In addition to seaming the segments together, an attachment member is coupled to the sides of the newly created single print substrate. As previously discussed, the attachment member is a border which facilitates the attachment of the printed substrate to its display location, such as, the billboard. In some embodiments, the attachment member is only placed around some of the sides.

The preassembly of the print substrate segments is preferably performed prior to the need for the preassembled substrate. As the print substrate segments 2 are assembled, the they are stored in a predefined area. In some embodiments, the preassembled substrates are stored near the loading station 12 of the printing system. By preassembling a supply of full image size substrates, upon the commencement of a printing job, post production time is virtually eliminated as the need to assemble the printed segments into an image is removed. As such, the delivery time for the final product is reduced. Indeed, in one preferred embodiment, the delivery time of completed products can be reduced from 2-5 weeks, to 3-5 days.

As discussed above, the preassembly of the print substrate segments can occur at any time, and is not dependent upon the receipt of a print request. Once a print request is received, the image is edited 126, wherein editing the image includes size enhancements or reductions, color corrections, and the like. The edited image is then stored 128 on a readable medium, such as a floppy disk or hard drive, for use in the processor 26. At the commencement of the printing job, the processor 26 instructs the print head 24 in the manner of printing the image 130 onto the preassembled substrate. Upon the completion of the print job, the printed substrate is packaged for delivery to the client 132. In preferred embodiments, the printing task is completed within 8 to 10 minutes. It is to be further understood that printing requests can also be received via a network, wherein the processor 26 is coupled to a network that is coupled to other computers, for example, client computers. In this manner, orders or requests can be received from virtually any location. The request would then be processed in accordance with the above described embodiments.

Although the foregoing described the invention with preferred embodiments, this is not intended to limit the invention. Indeed, it is to be understood that embodiments of the instant invention can be configured to include any number of printing apparatus such that a plurality of printing tasks can be accomplished in substantially simultaneously. Further, embodiments of the instant invention are not intended to limit the type of print head that can be utilized in the printing system. Further still, embodiments of the present invention can be configured such that images are directly transmitted to the processor via a network of computers, such as, the World Wide Web or the Internet. In this embodiment, the system could be configured for complete automation such that the printing could occur without intervention as long as a print substrate was preloaded. Rather than limit the invention, the foregoing is intended to cover all modifications and alternative constructions falling within the spirit and scope of the invention.

What is claimed is:

1. A system for printing an entire image on oversized print media, comprising:

a transportation system having a track;

a printing station, comprising a moveable print head;

an unloading station and delivery station;

a platform, the platform comprising a clamping device and an expandable member, wherein the clamping device is coupled to the expandable member, wherein the platform is sized to receive an oversized print substrate, the print substrate being sized to correspond to a desired product size, the clamping device being configured to releasably couple to the print substrate and secure the print substrate to the platform, and wherein the platform resides on the track and moves along the track in a translational motion;

wherein the printing station and the unloading station and delivery station are coupled together by the track; the platform and print substrate being linearly translated along the track to each station; and wherein the print head is configured to scan across the print substrate in a direction perpendicular to the translational motion of the print substrate.

2. A system as claimed in claim 1, wherein the print head is configured to linearly translate across the substrate in a plane parallel to the plane of the substrate.

3. A method for printing an image on oversized print media via a printing system comprising a transportation system having a track, wherein the track comprises a rail having a groove: a printing station, comprising a moveable print head; a platform, wherein the platform is sized to receive an oversized print substrate, the print substrate being sized to correspond to a desired product size, and wherein the platform resides on the track and moves along the track in a translational motion; wherein the printing station and the unloading station and delivery station are coupled together by the track; the platform and print substrate being linearly translated along the track to each station; and wherein the print head is configured to scan across the print substrate in a direction perpendicular to the translational motion of the print substrate, a copy of the image being received by the printing apparatus from a client, comprising:

assembling a single print substrate, wherein the single print substrate comprises a plurality of smaller print substrate segments;

editing and adjusting the print parameters for the image;

scanning the image and storing the image on s storage medium;

printing the image onto the preassembled single print substrate; and delivering the printed substrate to the client, wherein the assembling the print substrate further comprises coupling the plurality of smaller print substrate segments to form a unitary substrate sized to receive the image during printing.

4. A system for printing an entire image on oversized print media, comprising:

a transportation system having a track, wherein the track comprises a rail having a groove;

an unloading station and delivery station;

a printing station, comprising a moveable print head;

a platform, wherein the platform is sized to receive an oversized print substrate, the print substrate being sized to correspond to a desired product size, and wherein the platform resides on the track and moves along the track in a translational motion; and a transport mechanism having a guidance system, wherein the guidance system couples to the rail of the track and is configured to move the platform along the track, wherein the printing station and the unloading station and delivery station are coupled together by the track; the platform and print substrate being linearly translated along the track to each station; and wherein the print head is configured to scan across the print substrate in a direction perpendicular to the translational motion of the print substrate.

5. A system as claimed in claim 4, wherein the print substrate comprises a plurality of smaller substrate segments.

6. A system as claimed in claim 4, further comprising:

a loading station; and wherein the print station further comprises a stationary print platform.

7. A method for printing an image on oversized print media on a printing apparatus having a transportation system comprising a track; a printing station; an unloading station and delivery station; and a platform, wherein the platform resides on the track; and wherein the printing station, unloading station and delivery station are coupled together via the track; a copy of the image being received by the printing apparatus from a client, comprising:

assembling a single print substrate, wherein the single print substrate comprises a plurality of smaller print substrate segments, and wherein the assembling the print substrate further comprises coupling the plurality of smaller print substrate segments to form a unitary substrate sized to receive the image during printing, editing and adjusting the print parameters for the image;

scanning the image and storing the image on a storage medium;

printing the image onto the preassembled single print substrate; and delivering the printed substrate to the client.

* * * * *